US008334640B2

(12) United States Patent
Reed et al.

(10) Patent No.: US 8,334,640 B2
(45) **Date of Patent: *Dec. 18, 2012**

(54) TURBULENT FLOW COOLING FOR ELECTRONIC BALLAST

(75) Inventors: William G. Reed, Seattle, WA (US); John O. Renn, Lake Forest Park, WA (US)

(73) Assignee: Express Imaging Systems, LLC, Seattle, WA (US)

( * ) Notice: Subject to any disclaimer, the term of this patent is extended or adjusted under 35 U.S.C. 154(b) by 57 days.

This patent is subject to a terminal disclaimer.

(21) Appl. No.: 12/540,250

(22) Filed: Aug. 12, 2009

(65) Prior Publication Data

US 2010/0090577 A1 Apr. 15, 2010

Related U.S. Application Data

(60) Provisional application No. 61/088,651, filed on Aug. 13, 2008.

(51) Int. Cl.
*H01J 7/26* (2006.01)
*F21V 29/00* (2006.01)
*H01K 1/58* (2006.01)

(52) U.S. Cl. ..... 313/35; 362/294; 362/373; 313/46

(58) Field of Classification Search ..... 313/35, 313/36, 46; 362/373, 294

See application file for complete search history.

(56) References Cited

U.S. PATENT DOCUMENTS 5,160,202 A 11/1992 Legare ..... 362/153.1
6,094,919 A 8/2000 Bhatia
6,111,739 A 8/2000 Wu et al.
6,230,497 B1 5/2001 Morris et al.
6,499,860 B2 12/2002 Begemann
6,601,972 B2 8/2003 Sei et al.
6,885,134 B2 4/2005 Kurashima et al.
6,948,829 B2 9/2005 Verdes et al.

(Continued)

FOREIGN PATENT DOCUMENTS

DE 4001980 8/1990

(Continued)

OTHER PUBLICATIONS

U.S. Appl. No. 12/437,467, filed May 7, 2009, Reed et al.

(Continued)

*Primary Examiner* — Karabi Guharay
*Assistant Examiner* — Michael Santonocito
(74) *Attorney, Agent, or Firm* — Seed IP Law Group PLLC

(57) ABSTRACT

An apparatus for heat dissipation for a luminaire comprises an active heat transfer device and a thermally-conductive housing. The active heat transfer device causes turbulence in an ambient fluid. The thermally-conductive housing includes a cavity and a first end. The cavity is structured for an electronic ballast of the luminaire to be housed therein and thermally attached to an interior surface of the housing to allow the housing to absorb at least a portion of heat generated by the electronic ballast. The first end is structured for the active heat transfer device to be mountable to the first end of the housing. The housing further includes at least one thermally-conductive protrusion extending from an exterior surface of the housing and exposed to the turbulence in the ambient fluid to transfer at least a portion of the heat absorbed by the housing to the ambient fluid.

17 Claims, 6 Drawing Sheets

U.S. PATENT DOCUMENTS

| | | | | |
|---|---|---|---|---|
| 6,964,501 | B2 | 11/2005 | Ryan | |
| 7,144,140 | B2 | 12/2006 | Sun et al. | |
| 7,165,866 | B2 | 1/2007 | Li | 362/294 |
| 7,213,940 | B1 | 5/2007 | Van De Ven et al. | |
| 7,239,087 | B2 | 7/2007 | Ball | 315/128 |
| 7,252,385 | B2 | 8/2007 | Engle et al. | |
| 7,314,261 | B2 | 1/2008 | Jackson Pulver et al. | |
| 7,317,403 | B2 | 1/2008 | Grootes et al. | 340/815.45 |
| 7,330,002 | B2 | 2/2008 | Joung | |
| 7,339,323 | B2 | 3/2008 | Bucur | 315/128 |
| 7,341,362 | B2 | 3/2008 | Bjornson et al. | |
| 7,387,403 | B2 | 6/2008 | Mighetto | |
| 7,438,440 | B2 | 10/2008 | Dorogi | |
| 7,458,330 | B2 | 12/2008 | MacDonald et al. | |
| 7,475,002 | B1 | 1/2009 | Mann | |
| 7,524,089 | B2 | 4/2009 | Park | |
| 7,556,406 | B2 | 7/2009 | Petroski et al. | 362/294 |
| 7,626,342 | B2 | 12/2009 | Sun et al. | 315/247 |
| 7,637,633 | B2 | 12/2009 | Wong | |
| 7,695,160 | B2 | 4/2010 | Hirata et al. | |
| 7,874,710 | B2 | 1/2011 | Tsai et al. | |
| 7,901,107 | B2 | 3/2011 | Van De Ven et al. | |
| 2004/0095772 | A1 | 5/2004 | Hoover et al. | 362/363 |
| 2004/0105264 | A1 | 6/2004 | Spero | |
| 2004/0120148 | A1 | 6/2004 | Morris et al. | |
| 2005/0135101 | A1 | 6/2005 | Richmond | 362/276 |
| 2005/0174780 | A1 | 8/2005 | Park | |
| 2005/0243022 | A1 | 11/2005 | Negru | 345/46 |
| 2005/0254013 | A1 | 11/2005 | Engle et al. | |
| 2006/0001384 | A1 | 1/2006 | Tain et al. | |
| 2006/0056172 | A1 | 3/2006 | Fiene | 362/147 |
| 2006/0098440 | A1 | 5/2006 | Allen | 362/294 |
| 2006/0158130 | A1 | 7/2006 | Furukawa | 315/200 R |
| 2006/0202914 | A1 | 9/2006 | Ashdown | |
| 2006/0277823 | A1 | 12/2006 | Barnett et al. | 47/33 |
| 2007/0096118 | A1 | 5/2007 | Mahalingam et al. | |
| 2007/0102033 | A1 | 5/2007 | Petrocy | |
| 2007/0230183 | A1 | 10/2007 | Shuy | 362/294 |
| 2007/0247853 | A1* | 10/2007 | Dorogi | 362/294 |
| 2007/0279921 | A1* | 12/2007 | Alexander et al. | 362/368 |
| 2007/0285920 | A1 | 12/2007 | Seabrook | 362/240 |
| 2008/0232119 | A1* | 9/2008 | Ribarich | 362/373 |
| 2008/0253125 | A1 | 10/2008 | Kang et al. | 362/294 |
| 2008/0309240 | A1 | 12/2008 | Goray et al. | 315/56 |
| 2009/0109625 | A1* | 4/2009 | Booth et al. | 361/702 |
| 2009/0278474 | A1 | 11/2009 | Reed et al. | 315/294 |
| 2009/0284155 | A1 | 11/2009 | Reed et al. | 315/32 |
| 2010/0060130 | A1* | 3/2010 | Li | 313/46 |
| 2010/0123403 | A1 | 5/2010 | Reed | 315/193 |
| 2010/0277082 | A1 | 11/2010 | Reed et al. | 315/159 |
| 2010/0295946 | A1 | 11/2010 | Reed et al. | 348/164 |

FOREIGN PATENT DOCUMENTS

| | | | |
|---|---|---|---|
| DE | 198 10 827 | A1 | 9/1999 |
| FR | 2883306 | | 9/2006 |
| JP | 2006-31977 | A | 2/2006 |
| WO | 2006/057866 | | 6/2006 |
| WO | 2008/030450 | | 3/2008 |
| WO | 2009/040703 | A2 | 4/2009 |

OTHER PUBLICATIONS

U.S. Appl. No. 12/437,472, filed May 7, 2009, Reed et al.
U.S. Appl. No. 61/051,619, filed May 8, 2008, Reed et al.
U.S. Appl. No. 61/052,924, filed May 13, 2008, Reed et al.
U.S. Appl. No. 61/088,651, filed Aug. 13, 2008, Reed et al.
U.S. Appl. No. 61/115,438, filed Nov. 17, 2008, Reed.
U.S. Appl. No. 61/154,619, filed Feb. 23, 2009, Reed.
U.S. Appl. No. 61/174,913, filed May 1, 2009, Reed et al.
U.S. Appl. No. 61/180,017, filed May 20, 2009, Reed et al.
U.S. Appl. No. 61/229,435, filed Jul. 29, 2009, Reed et al.
Reed et al., "Apparatus, Method to Change Light Source Color Temperature with Reduced Optical Filtering Losses," U.S. Appl. No. 61/295,519, filed Jan. 15, 2010, 35 pages.
Reed et al., "Electrically Isolated Heat Sink for Solid-State Light," U.S. Appl. No. 12/846,516, filed Jul. 29, 2010, 29 pages.
Renn et al., "Solid State Lighting Device and Method Employing Heat Exchanger Thermally Coupled Circuit Board," U.S. Appl. No. 61/357,421, filed Jun. 22, 2010, 49 pages.
International Search Report, mailed Jul. 9, 2009 for PCT/US2009/043171, 3 pages.
Written Opinion, mailed Jul. 9, 2009 for PCT/US2009/043171, 8 pages.
International Search Report, mailed Jun. 21, 2010 for PCT/US2009/064625, 3 pages.
Written Opinion, mailed Jun. 21, 2010 for PCT/US2009/064625, 5 pages.
International Search Report, mailed Jun. 10, 2009 for PCT/US2009/043170, 4 pages.
Written Opinion, mailed Jun. 10, 2009 for PCT/US2009/043170, 7 pages.
International Search Report, mailed Nov. 29, 2010 for PCT/US2010/033000, 3 pages.
Written Opinion, mailed Nov. 29, 2010 for PCT/US2010/033000, 5 pages.
"A Review of the Literature on Light Flicker: Ergonomics, Biological Attributes, Potential Health Effects, and Methods in Which Some LED Lighting May Introduce Flicker," IEEE Standard P1789, Feb. 26, 2010, 26 pages.
International Search Report, mailed Sep. 29, 2011 for PCT/US2011/041402, 3 pages.
Written Opinion, mailed Sep. 29, 2011 for PCT/US2011/041402, 4 pages.
Reed et al., "Gas-Discharge Lamp Replacement," Amendment filed Sep. 6, 2011 for U.S. Appl. No. 12/437,467, 14 pages.
Reed et al., "Gas-Discharge Lamp Replacement," Office Action mailed Jun. 22, 2011, 12 pages.
Reed et al., "Gas-Discharge Lamp Replacement," Office Action mailed Nov. 17, 2011 for U.S. Appl. No. 12/437,467, 15 pages.

* cited by examiner

TURBULENT FLOW COOLING FOR ELECTRONIC BALLAST

CROSS REFERENCE TO RELATED APPLICATIONS

This application claims benefit under 35 U.S.C. 119(e) of U.S. Provisional Patent Application Serial No. 61/088,651, filed Aug. 13, 2008 and entitled "Turbulent Flow Cooling for Electronic Ballast," which is incorporated herein by reference in its entirety.

BACKGROUND

1. Technical Field

This disclosure generally relates to the field of luminaire, and more particularly to dissipation of the heat generated by ballast electronics of a luminaire.

2. Description of the Related Art

With increasing trend of energy conservation and for various other reasons, including replacement of gas-vapor lamps, solid-state lighting has become more and more popular as the source of illumination in a wide range of applications. As generally known, solid-state lighting refers to a type of lighting that emits light from a solid object, such as a block of semiconductor, rather than from a vacuum or gas tube as is the case in traditional lighting. Examples of solid-state lighting include light-emitting diodes (LEDs), organic light-emitting diodes (OLEDs), and polymer light-emitting diodes (PLEDs). Solid-state lighting as compared to traditional lighting generates visible light with reduced parasitic energy dissipation in the form of reduced heat generation. Further, solid-state lighting tends to have increased lifespan compared to traditional lighting. This is because, due to its solid-state nature, solid-state lighting provides for greater resistance to shock, vibration, and wear.

An LED lamp is a type of solid-state lighting that utilizes LEDs as a source of illumination, and typically has clusters of LEDs in a suitable housing. The LEDs in an LED lamp typically have very low dynamic resistance, with the same voltage drop for widely-varying currents. Thus, the LEDs cannot be connected directly to most power sources, such as the 120-volt AC mains commonly available in the U.S., without causing damages to the LEDs. Consequently, an electronic ballast is used to transform the high voltage and current from the AC mains into a typically lower voltage with a regulated current.

The electronic ballasts used in LED lamps have a typical conversion efficiency of 75%-95%, and more typically 85%. This means that 5% -25% of the energy used by a solid-state luminaire is wasted as heat, generated by the electronic ballast. This heat must be removed from the electronic ballast to prevent premature failure of the electronic components of the ballast. In a high-flux luminaire of, for example, 40 watts, about 8.8 watts of waste heat must be removed. However, passive cooling method using heat sink fins will not likely be able to keep temperature rise of the electronic components within safe limits if the ballast is installed in a recessed "can light" or security light type of luminaire. This is because, with such enclosed lamp mounting spaces, there is insufficient airflow to safely cool the electronic ballast.

There is, therefore, a need for an active cooling method and apparatus to more effectively remove the heat generated by the electronic ballast in a solid-state lighting, such as a LED lamp, to keep the temperature of the electronic components of the ballast within safe limits.

BRIEF SUMMARY

In one aspect, an apparatus for heat dissipation for a luminaire comprises an active heat transfer device and a thermally-conductive housing. The active heat transfer device causes turbulence in an ambient fluid. The thermally-conductive housing includes a cavity and a first end. The cavity is structured for an electronic ballast of the luminaire to be housed therein and thermally attached to an interior surface of the housing to allow the housing to absorb at least a portion of heat generated by the electronic ballast. The first end is structured for the active heat transfer device to be mountable to the first end of the housing. The housing further includes at least one thermally-conductive protrusion extending from an exterior surface of the housing and exposed to the turbulence in the ambient fluid to transfer at least a portion of the heat absorbed by the housing to the ambient fluid.

In another aspect, a device to assist active heat dissipation for a luminaire having an active cooler comprises an electronic ballast, a thermally-conductive housing, and at least one thermally-conductive protrusion extending from an outer perimeter of the housing. The thermally-conductive housing houses the electronic ballast of the luminaire therein so the electronic ballast is thermally coupled to the housing to allow at least a portion of heat generated by the electronic ballast to dissipate into the housing. The housing further includes at least one mounting structure to mount a base of the luminaire and the active cooler to the thermally-conductive housing.

In yet another aspect, a method of actively cooling an electronic ballast of a luminaire includes providing a thermally-conductive housing to house the electronic ballast of the luminaire therein, the housing having at least one thermally-conductive protrusion. The method also includes thermally coupling the electronic ballast to the housing to allow at least a portion of heat generated by the electronic ballast to be transferred to the housing. The method further includes causing turbulence in an ambient fluid surrounding the at least one protrusion of the housing.

Figure 1:
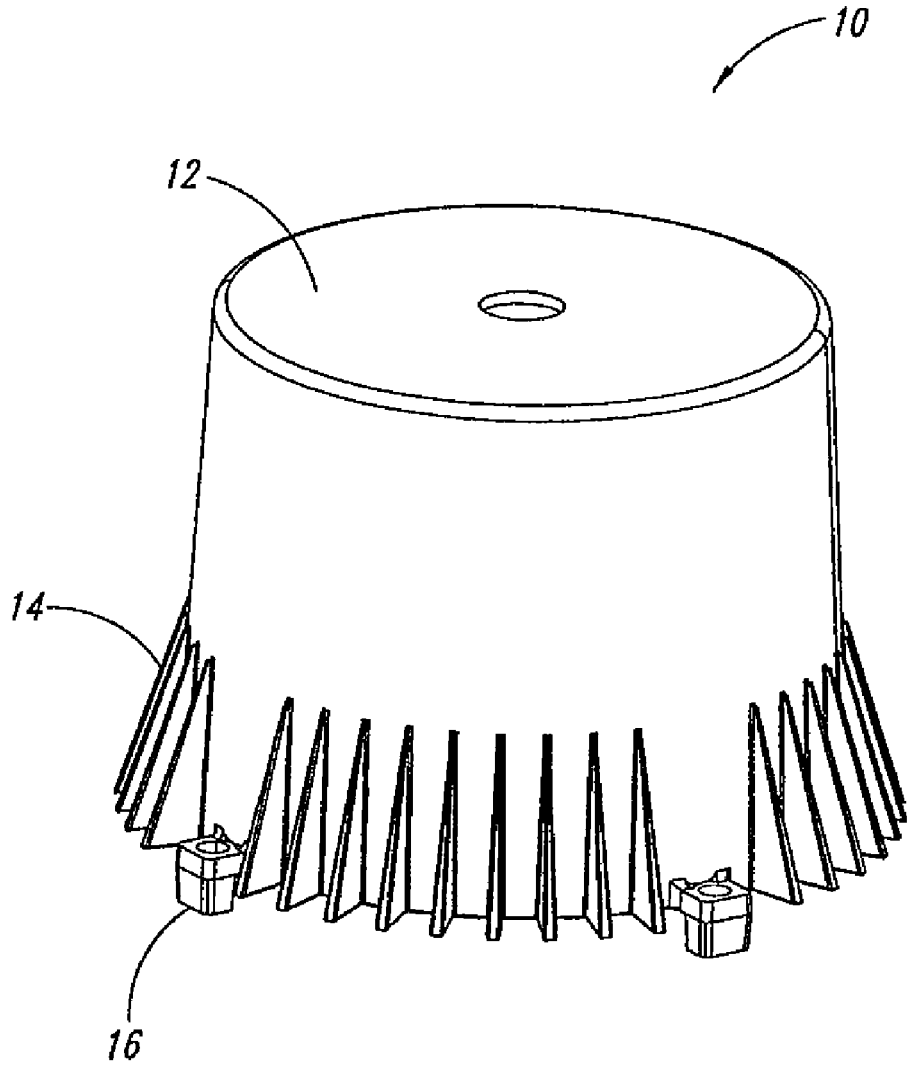
FIG. 1 is a diagram showing a luminaire enclosure device equipped with fins according to one non-limiting illustrated embodiment.

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with lighting fixtures, power generation and/or power system for lighting have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings and Abstract of the Disclosure provided herein are for convenience only and do not interpret the scope or meaning of the embodiments.

Figure 2:
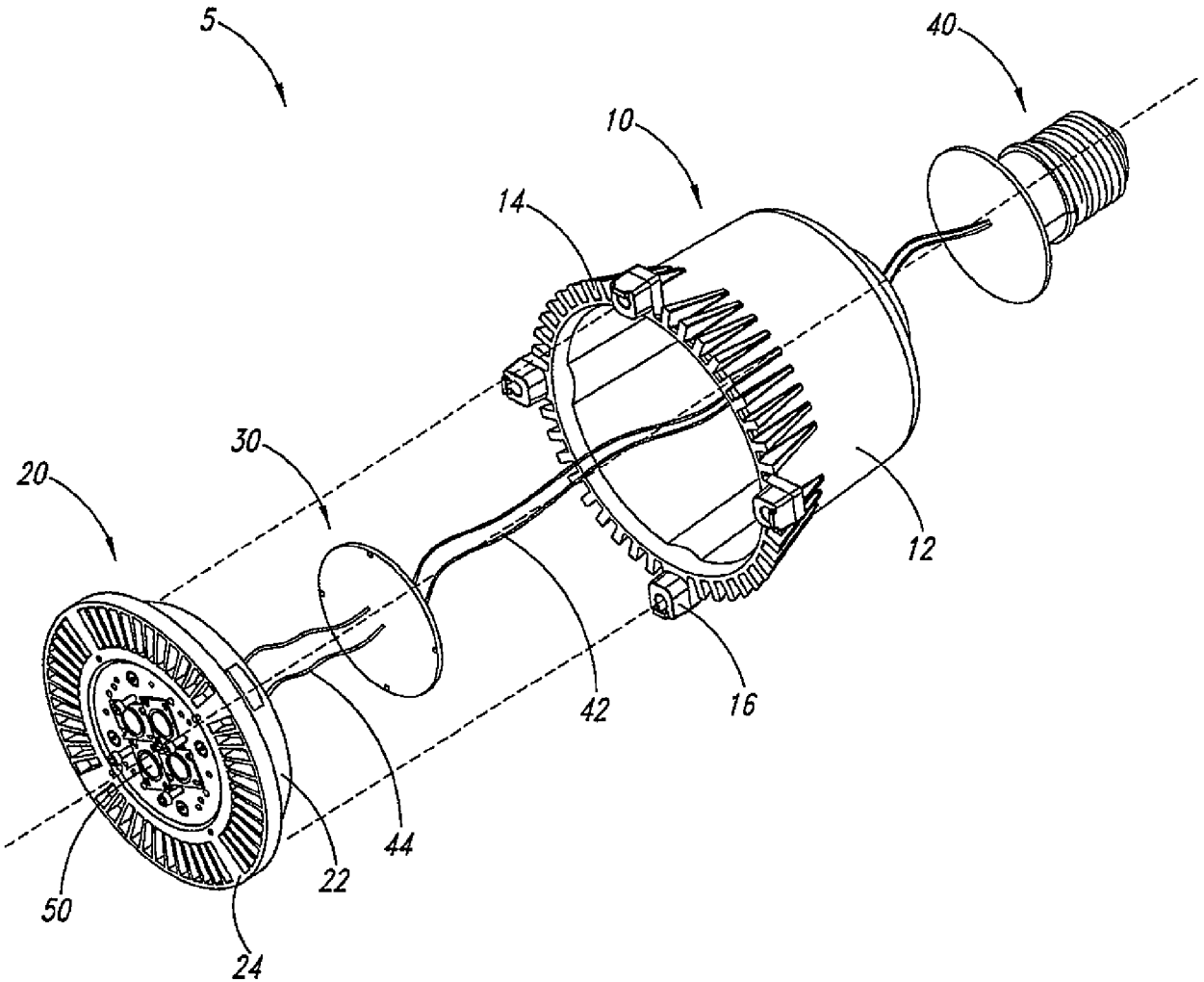
FIG. 2 is an assembly diagram showing an illumination device utilizing an enclosure device according to one non-limiting illustrated embodiment.

FIG. 1 shows a luminaire enclosure device 10 according to one non-limiting illustrated embodiment. The enclosure device 10 comprises a housing 12 and a plurality of protrusions 14. The housing 12 may be formed in a generally cylindrical shape, for example, with a first opening (not shown) at a first end of the housing 12 that is sized for an electronic ballast 30 of the luminaire (FIG. 2) to be housed in the housing 12. The housing 12 may have a second opening at a second end of the housing 12, e.g., opposite the first end, that is sized to allow a base assembly 40 (FIG. 2) to be mounted to the housing 12 and allow power wires 42 (FIG. 2) to traverse through to provide electrical power to the electronic ballast, a light source 50 of the luminaire (FIG. 2), and an active heat transfer device 20 (FIG. 2).

In one embodiment, the plurality of protrusions 14 may be located around the outer perimeter of the housing 12 as shown in FIG. 1. The protrusions 14 increase the surface area of the enclosure device 10 to promote heat transfer between the enclosure device 10 and the ambient environment (e.g., air). The spacing between every two protrusions may or may not be equal to one another, and will be discussed in more detail below. In an embodiment, the plurality of protrusions 14 may be shaped as fins as shown in FIG. 1. It will be appreciated by those skilled in the art that, although the protrusions 14 are shown as triangular-shaped fins, the protrusions 14 may be in different shapes. In one embodiment, the protrusions 14 may be an integral part of the housing 12. In an alternative embodiment, the protrusions 14 may be attached tightly to the outer surface of the housing 12 to ensure efficient heat transfer. The protrusions 14 add to the total surface area of the enclosure device 10, making the enclosure device 10 a heat sink having a higher heat transfer efficiency than it would have if without the protrusions 14.

In one embodiment, the enclosure device 10, including the housing 12 and the protrusions 14, is preferably made of thermally-conductive material such as metal, for example, aluminum, aluminum alloy, copper, copper alloy, or other suitable material having desirable thermal conductivity. With good thermal conductivity, the enclosure device 10 will be able to absorb at least a portion of the heat generated by a heat-generating component housed therein and dissipate at least a portion of the absorbed heat into the ambient environment, e.g., the ambient fluid such as air or water that surrounds the enclosure device 10. To promote better heat transfer from the heat-generating component, e.g., the electronic ballast 30, to the housing 12, the heat-generating component is preferably thermally attached to the housing 12. When the heat-generating component is thermally attached or conductively coupled to the housing 12, heat from the heat-generating component can be transferred to the housing 12 by conduction, in addition to convection and radiation. When the heat-generating component is enclosed in housing 12 and there is not much airflow within the housing 12, conduction is typically the most effective method of heat transfer compared to convection and radiation.

In one embodiment, the heat-generating component may be bonded to the housing 12 with a type of thermally-conductive adhesive 32 (FIG. 4A) such as, for example, the thermally-conductive epoxy TC-2810 by 3M™. In another embodiment, the heat-generating component may be mechanically secured to the housing 12 by, for example, screws and/or nuts and bolts 34 (FIG. 4B). In yet another embodiment, the heat-generating component may be thermally attached to the housing 12 both by bonding with thermally-conductive adhesive and by mechanical means such as screws and/or nuts and bolts or other fasteners.

The enclosure device 10 may, in one embodiment, further include mounting extensions 16 that protrude from the outer perimeter of the housing 12. The mounting extensions 16 are configured for mounting another object, e.g., the active heat transfer device 20, to the housing 12.

FIG. 2 shows an assembly of an illumination device 5 utilizing the enclosure device 10 according to one non-limiting illustrated embodiment. In one embodiment, as shown in FIG. 2, the illumination device 5 may be a solid-state luminaire that includes the enclosure device 10, an active heat transfer device 20, an electronic ballast 30, a base assembly 40, and a solid-state lighting source 50. In one embodiment, the solid-state lighting source 50 may comprise multiple LEDs. Electrical power may be provided to the solid-state lighting source 50 from, for example, AC power mains through the base assembly 40, power wirings 42, the electronic ballast 30, and then regulated power wirings 44. The power wirings for the active heat transfer device 20 and other components of the illumination device 5, such as a substantially transparent cover that protects the solid-state lighting source 50 from physical damage, are not shown in order to keep FIG. 2 uncluttered.

In one embodiment, the electronic ballast 30 may be housed in the enclosure device 10, with the active heat transfer device 20 mounted to the first end of the housing 12 and the base assembly 40 mounted to the second end of the housing 12. In other words, the electronic ballast 30 may be enclosed in the housing 12 when the illumination device 5 is assembled. Heat generated by the electronic ballast 30 may be transferred to the enclosure device 10 via conduction, convection, and radiation. In one embodiment, the electronic ballast 30 is thermally attached or coupled to the housing 12 of the enclosure device 10 as explained above to promote heat transfer from the electronic ballast 30 to the housing 12, and subsequently to the protrusions 14. At least a portion of the heat in the housing 12 and the protrusions 14 is then transferred to the ambient air. The rate of heat transfer from the enclosure device 10, especially the protrusions 14, to the ambient air can be greatly improved with the aid of the active heat transfer device 20.

The active heat transfer device 20, in one embodiment, may include a heat sink 24 and an active cooler 22. The solid-state lighting source 50 is mounted to and in direct contact with the heat sink 24. In an embodiment, the heat sink 24 includes multiple fins that increase surface area to enhance the transfer of heat from the heat sink 24 to the ambient air.

In one embodiment, the active cooler 22 may be a synthetic jet air mover and, when powered, causes ambient fluid, e.g., air, in the surrounding to circulate through the active cooler 22 and around the heat sink 24, and thereby creating turbulent flow of cooling air over fins of the heat sink 24 as well as the protrusions 14 of the enclosure device 10. In one embodiment, the active cooler 22 comprises a synthetic jet air mover, such as one of those manufactured by Nuventix™, which takes air in relatively slowly and ejects the same air relatively rapidly. As air moves around and past the surfaces of the heat sink 24, thermal energy is transferred (e.g., by convection) from the heat sink 24 to the air and thereby promotes the transfer of heat away from the solid-state lighting source 50. In another embodiment, the active cooler 22 may be a fan or other type of air mover. In an alternative embodiment, the active cooler 22 may be an active cooler that moves a fluid other than ambient air to provide cooling for the heat sink 24 and the solid-state lighting source 50. The fluid may be, for example, water, another type of gas or liquid, or any combination thereof.

In one embodiment, the active cooler 22 may have multiple openings through which turbulent flow of air is ejected out. The protrusions 14 of the enclosure device 10 may be located around the outer perimeter of the housing 12 in a fashion that each protrusion 14 corresponds to and is aligned with a respective one of the openings of the active cooler 22. Alternatively, the protrusions 14 may be located around the outer perimeter of the housing 12 in a way that the spacing between every two protrusions 14 is aligned with a respective one of the openings of the active cooler 22. The goal may be to maximize exposure of the protrusions 14 to the turbulent airflow so that heat in the enclosure device 10 can be rapidly transferred to the ambient air to keep temperature rise in the electronic ballast 30 within safe limits.

In one embodiment, the solid-state lighting source 50 is mounted to one side of the heat sink 24 while the active cooler 22 is mounted to another side of the heat sink 24. Because the solid-state lighting source 50 is at a higher temperature than the heat sink 24 when the solid-state lighting source 50 is emitting light, the resultant temperature gradient allows the heat sink 24 to absorb at least a portion of the heat generated by the solid-state lighting source 50 and thereby reduce the temperature of the solid-state lighting source 50. However, thermal modeling has shown that without active cooling, a heat sink, such as the heat sink 24, will not be able to keep the junction temperature of the solid-state lighting source 50 below a level sufficient to prevent a reduction of the operational life of the solid-state lighting source 50. In other words, the heat sink 24 by itself alone can remove thermal energy from the solid-state lighting source 50 at a low rate, but it can remove thermal energy from the solid-state lighting source 50 at a higher rate when utilized with the active cooler 22 to keep the temperature of the solid-state lighting source 50 sufficiently low.

Figure 3:
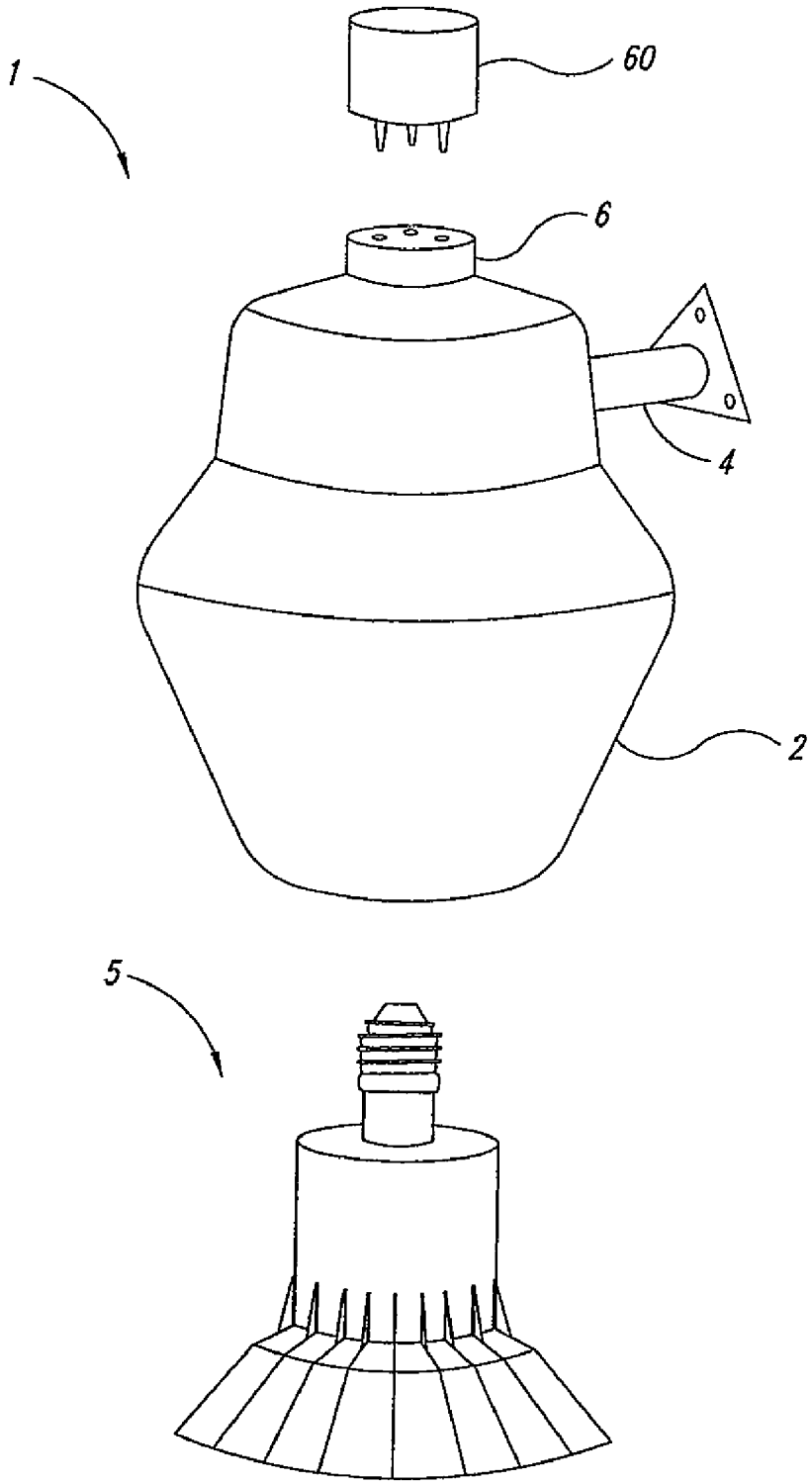
FIG. 3 is an assembly diagram showing a light fixture fitted with an illumination device according to one non-limiting illustrated embodiment.

FIG. 3 shows a light fixture 1 fitted with the solid-state illumination device 5 according to one non-limiting illustrated embodiment. The light fixture 1 may include a lamp housing 2 attached to a luminaire mount 4, which is used to mount the light fixture 1 to a structure such as a lamp post, wall, or the like. The lamp housing 2 may have a sensor socket 6, where a photo detector or an activation device 60 (e.g., motion sensor) may be inserted into. The light fixture 1 additionally has a receptacle (not shown), such as a threaded socket, into which a lamp or an illumination device such as the solid-state illumination device 5 may be inserted. The solid-state illumination device 5 may be a replacement of a gas-discharge lamp that is typically used with the light fixture 1, and is sized and shaped such that the solid-state illumination device 5 can fit inside the lamp housing 2 of the light fixture 1.

Figure 4A:
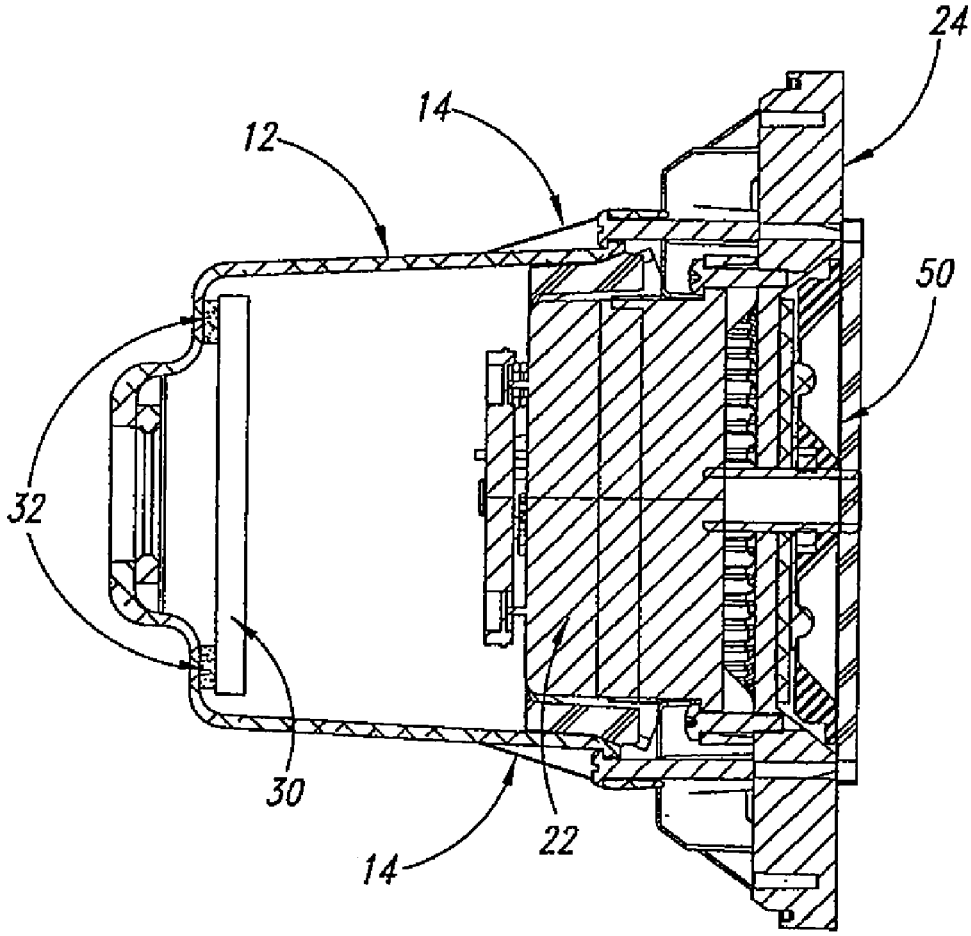
FIG. 4A is a diagram showing a cross-sectional view of the illumination device of FIG. 2 according to one non-limiting illustrated embodiment.
Figure 4B:
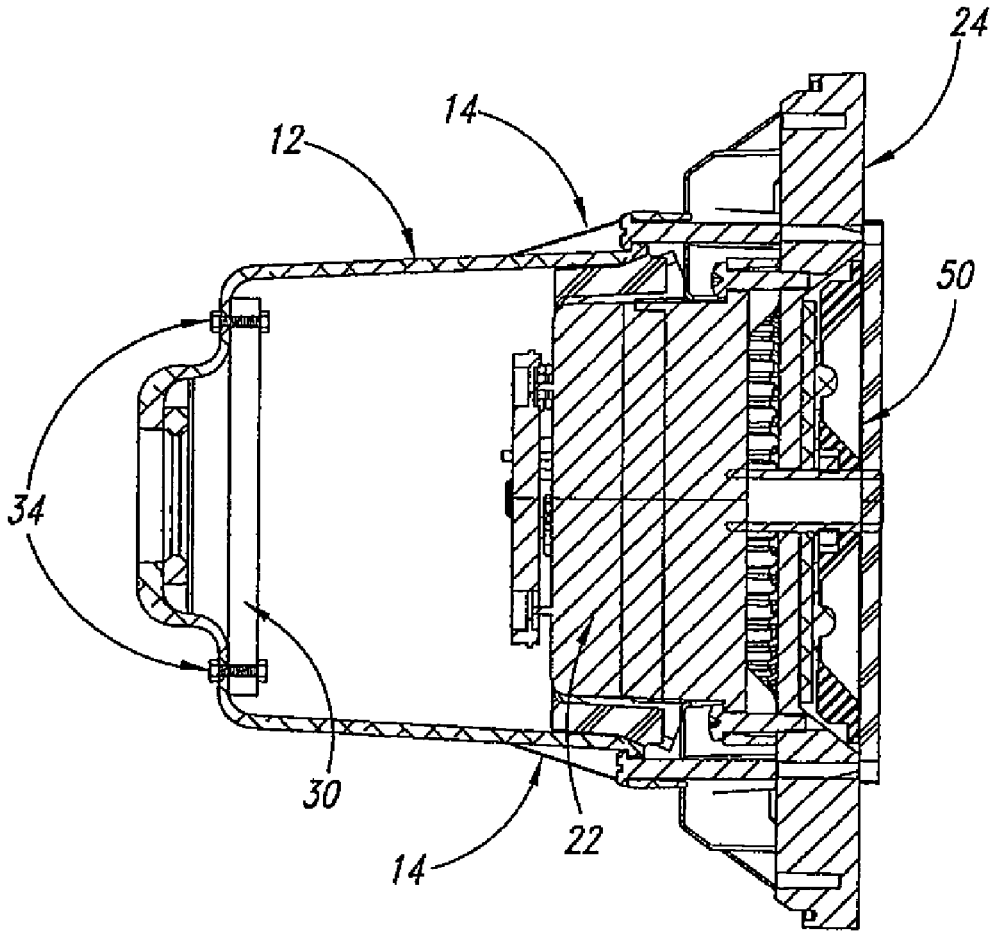
FIG. 4B is a diagram showing a cross-sectional view of the illumination device of FIG. 2 according to another non-limiting illustrated embodiment.

FIG. 4A shows a cross-sectional view of the solid-state illumination device 5 according to one non-limiting illustrated embodiment. As shown, the electronic ballast 30 may be thermally attached to the housing 12 by bonding with thermally-conductive adhesive 32.

FIG. 4B shows a cross-sectional view of the solid-state illumination device 5 according to another non-limiting illustrated embodiment. As shown, the electronic ballast 30 may be mechanically secured to the housing 12 by mechanical means such as screws and/or nuts and bolts 34. It will be appreciated by those skilled in the art that, although the electronic ballast 30 is thermally attached or coupled to the housing 12 at one particular location of the housing 12 (e.g., towards the second end of the housing 12) as shown in FIGS. 4A and 4B, the electronic housing 30 may alternatively be thermally attached or coupled to the housing 12 at another location within the inner perimeter of the housing 12. It will also be appreciated by those skilled in the art that, regardless of the particular location within the enclosure device 10 at which the electronic ballast 30 is thermally attached or otherwise coupled to the housing 12, at least a portion of the heat generated by the electronic ballast 30 will be transferred to the enclosure device 10, and then ultimately transferred to the ambient air with the aid of the turbulent airflow generated by the active heat transfer device 20.

Figure 5:
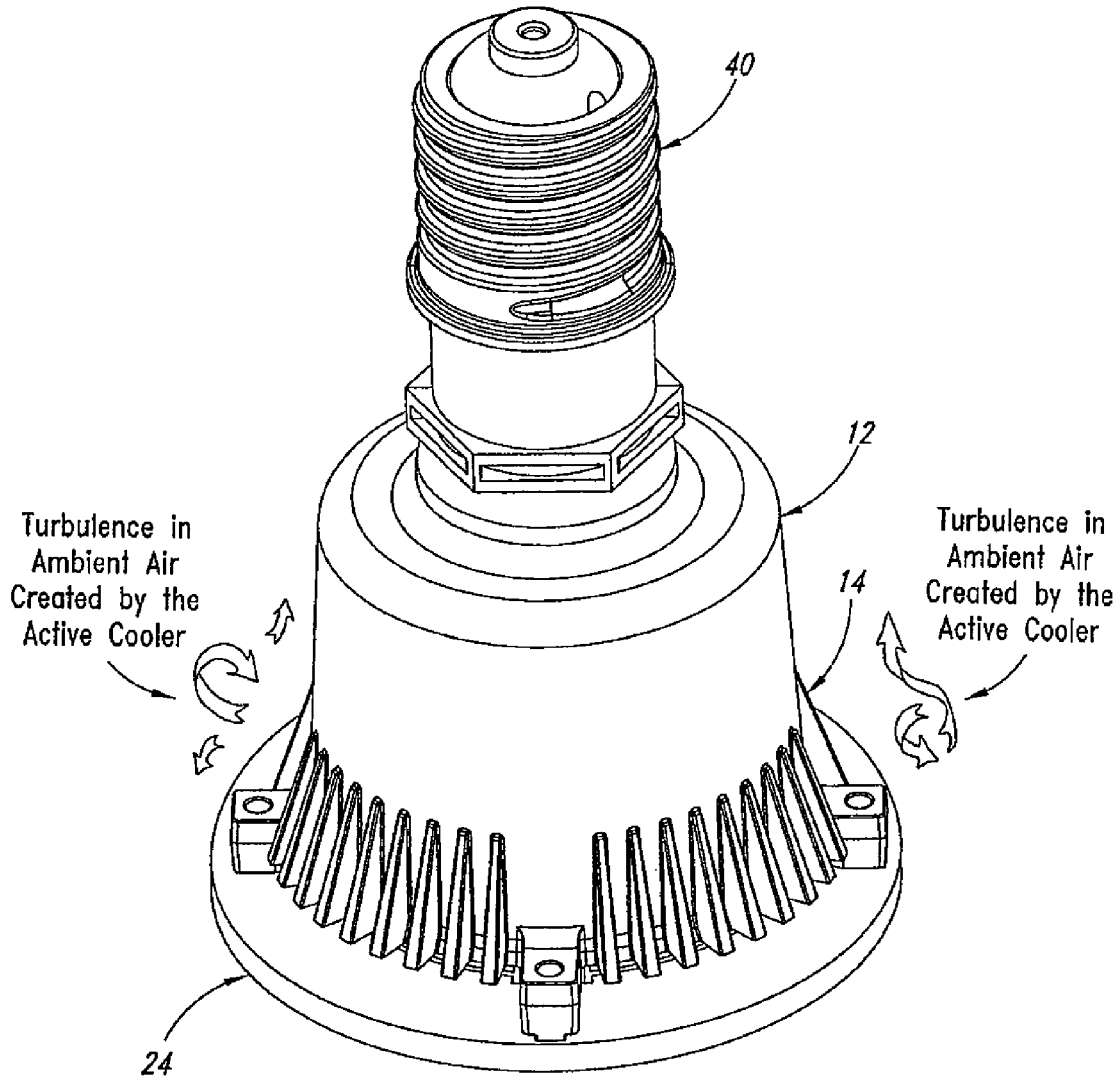
FIG. 5 is a diagram showing turbulence in airflow created by an active heat transfer device around an enclosure device according to one non-limiting illustrated embodiment.

FIG. 5 shows turbulence in airflow created by the active heat transfer device 20 around the protrusions 14 of the enclosure device 10 according to one non-limiting illustrated embodiment. It is expected that under normal conditions the ambient air is at a temperature lower than that of the electronic ballast 30 and of the enclosure device 10, so that due to temperature gradient heat can be transferred from the electronic ballast 30 to the enclosure device 10 and to the ambient air. With the turbulent airflow over and across the protrusions 14, heat transfer from the enclosure device 10 to the ambient air by convection should be greatly enhanced. As a result, the temperature of the electronic ballast 30 should be kept at a safe level to prevent damage to the components of the electronic ballast 30 due to excessive heating from insufficient cooling. To achieve substantial cooling, the protrusions 14 should be placed at the exact locations of the turbulent flow, for example, as shown in FIG. 5.

Thus, a luminaire enclosure device, such as the enclosure device 10, is disclosed herein and should greatly improve upon the problems associated with insufficient cooling with passive heat sink described above. For instance, embodiments of the present invention utilize the cooling system that is typically found in solid-state luminaires, e.g., the active heat transfer device 20, to also cool the electronic ballast 30 by providing small, thermally-conductive fins 14 at specific locations on the housing 12 where turbulent airflow is generated. By this method, heat generated in the sealed electronic ballast 30 is transferred through the wall of the enclosure device 10 and into the thermally-conductive fins 14.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other context, not necessarily the exemplary context of solid-state luminaire generally described above. It will be understood by those skilled in the art that, although the embodiments described above and shown in the figures are generally directed to the context of solid-state lighting, luminaire utilizing traditional or other non-solid state lighting source may also benefit from the concepts described herein. For example, although the embodiments described above and shown in the figures are directed to luminaires using solid-state lighting source, the concepts and the embodiments described herein are equally applicable to luminaires other than those using solid-state lighting source. Further, although an Edison (threaded) base assembly is shown in the figures, other types of base assembly, such as a mogul base assembly, may be used.

All of the U.S. patents, U.S. patent application publications, U.S. patent applications, foreign patents, foreign patent applications and non-patent publications referred to in this specification including, but not limited to: U.S. Provisional Patent Application Ser. No. 61/088,651, filed Aug. 13, 2008, entitled "Turbulent Flow Cooling for Electronic Ballast" and U.S. patent application Ser. No. 12/437,467, filed May 7, 2009, entitled "Gas-Discharge Lamp Replacement", are incorporated herein by reference, in their entirety and for all purposes. Aspects of the embodiments can be modified, if necessary, to employ systems, circuits and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

We claim:

1. An apparatus for heat dissipation for a luminaire, comprising:

a thermally-conductive housing having an exterior surface, an interior surface that forms a cavity, a first end with an opening to provide access to the cavity from an exterior of the housing, and a plurality of thermally-conductive protrusions that extend from the exterior surface of the housing and exposed to an ambient fluid on the exterior of the housing to at least one of convectively or radiantly thermally transfer heat from the housing to the ambient fluid on the exterior of the housing;

an electronic ballast mounted in the cavity of the housing and thermally conductively coupled to the interior surface of the housing to allow the housing to at least conductively absorb at least a portion of heat generated by the electronic ballast during use, and an active heat transfer device mounted at least proximate the first end of the housing to sealingly enclose the electronic ballast in the cavity of the housing at least during use and operable to cause turbulence in the ambient fluid on the exterior of the housing at least about the thermally-conductive protrusions to enhance convective transfer of heat to the ambient fluid from the plurality of thermally conductive protrusions.

2. The apparatus of claim 1 wherein the active heat transfer device comprises:

a heat sink to which a light source of the luminaire is conductively coupled for the heat sink to absorb at least a portion of heat generated by the light source; and an active cooler coupled to the heat sink and operable to cause turbulence in the ambient fluid when powered.

3. The apparatus of claim 1 wherein the active heat transfer device comprises at least one opening and is operable to eject turbulent flow from the at least one opening.

4. The apparatus of claim 3 wherein the plurality of thermally-conductive protrusions that extend from the exterior surface of the housing comprise a plurality of fins, and wherein each of the fins has at least two surfaces and is aligned with a respective one of the at least one opening of the active heat transfer device when the active heat transfer device is mounted to the housing so that the turbulent flow ejected from each of the at least one opening of the active heat transfer device flows over at least one of the at least two surfaces of a respective one of the fins.

5. The apparatus of claim 1 wherein the thermally-conductive housing comprises at least one type of metal.

6. The apparatus of claim 1 wherein the electronic ballast is bonded to the thermally-conductive housing with a thermally-conductive adhesive.

7. The apparatus of claim 1 wherein the electronic ballast is mechanically secured to the thermally-conductive housing.

8. The apparatus of claim 1 wherein the luminaire comprises a solid-state luminaire that emits light using a solid-state device.

9. The apparatus of claim 1, wherein the plurality of thermally-conductive protrusions that extend from the exterior surface of the housing includes a plurality of thermally-conductive protrusions extending from the exterior surface of the first end of the housing and not from a second end of the housing opposite the first end.

10. The apparatus of claim 1 wherein the active heat transfer device comprises:

a heat sink; and an active cooler coupled to the heat sink and operable to cause turbulence in the ambient fluid when powered, the apparatus further comprising:

a number of solid-state light sources carried by the heat sink and thermally conductively coupled thereto.

11. The apparatus of claim 10 wherein the active heat transfer device comprises at least one opening through which turbulent flow is ejected into the ambient fluid when the active cooler is powered and the at least one opening is positioned relatively forward of the thermally-conductive protrusions with respect to a direction into which light is emitted by the solid-state light sources.

12. A method of actively cooling an electronic ballast of a luminaire, the method comprising:

providing a thermally-conductive housing having an exterior surface, an interior surface that forms a cavity to house the electronic ballast of the luminaire therein, the housing having a first end with an opening to provide access to the cavity from an exterior of the housing, and a plurality of thermally-conductive protrusions extending from the exterior surface of the housing;

thermally coupling the electronic ballast to the housing to promote at least a portion of heat generated by the electronic ballast to be transferred to the housing and the plurality of thermally-conductive protrusions of the housing;

mounting an active heat transfer device to the housing at least proximate the first end of the housing to sealingly enclose the electronic ballast in the housing; and causing turbulence in an ambient fluid at least surrounding the plurality of protrusions of the housing to enhance convective transfer of heat to the ambient fluid from the plurality of protrusions.

13. The method of claim 12 wherein causing turbulence in the ambient fluid surrounding the plurality of protrusions of the housing comprises causing turbulence in the ambient fluid surrounding the plurality of protrusions of the housing by an active cooler that is coupled to the housing.

14. The method of claim 12 wherein the plurality of protrusions of the housing comprises a plurality of thermally-conductive fins.

15. The method of claim 12 wherein thermally coupling the electronic ballast to the housing comprises bonding the electronic ballast to the housing with a thermally-conductive adhesive.

16. The method of claim 12 wherein thermally coupling the electronic ballast to the housing comprises mechanically securing the electronic ballast to the housing.

17. The method of claim 12, further comprising providing power to a solid-state device of the luminaire that emits light in response.

* * * * *